US010573426B2

(12) United States Patent
Costello et al.

(10) Patent No.: US 10,573,426 B2
(45) **Date of Patent: *Feb. 25, 2020**

(54) FLUORINATED NITRILES AS DIELECTRIC GASES

(71) Applicant: 3M INNOVATIVE PROPERTIES COMPANY, St. Paul, MN (US)

(72) Inventors: Michael G. Costello, Afton, MN (US); Richard M. Flynn, Mahtomedi, MN (US); Michael J. Bulinski, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/997,808

(22) Filed: Jun. 5, 2018

(65) Prior Publication Data

US 2018/0286530 A1 Oct. 4, 2018

Related U.S. Application Data

(63) Continuation of application No. 14/388,301, filed as application No. PCT/US2013/031854 on Mar. 15, 2013.

(60) Provisional application No. 61/620,192, filed on Apr. 4, 2012.

(51) Int. Cl.

| | |
|---|---|
| ***H01B 3/56*** | (2006.01) |
| ***H01B 3/16*** | (2006.01) |
| ***H01B 3/24*** | (2006.01) |

(52) U.S. Cl.

CPC ..... *H01B 3/56* (2013.01); *H01B 3/16* (2013.01); *H01B 3/24* (2013.01)

(58) Field of Classification Search

CPC ..... H01B 3/56; H01B 3/24; H01B 3/16

See application file for complete search history.

(56) References Cited

U.S. PATENT DOCUMENTS

| | | | | |
|---|---|---|---|---|
| 2,713,593 A | | 7/1955 | Brice | |
| 3,048,648 A | * | 8/1962 | Plump | H01B 3/16 174/17 GF |
| 3,057,849 A | | 10/1962 | Tullock | |
| 3,102,889 A | * | 9/1963 | Gladding | C07C 251/72 252/78.1 |
| 3,170,949 A | * | 2/1965 | Proskow | C08G 73/0644 558/444 |
| 3,184,533 A | * | 5/1965 | Eiseman, Jr. | H01B 3/24 174/17 R |

(Continued)

FOREIGN PATENT DOCUMENTS

| | | |
|---|---|---|
| EP | 0128588 | 12/1984 |
| EP | 0129200 | 12/1984 |

(Continued)

OTHER PUBLICATIONS

English Translation of FR 1,265,731 A , Jun. 1961.*

(Continued)

*Primary Examiner* — Liam J Heincer
*Assistant Examiner* — M. Reza Asdjodi
(74) *Attorney, Agent, or Firm* — Adam Bramwell

(57) ABSTRACT

An electrical device containing a dielectric fluid, the dielectric fluid comprising heptafluoroisobutyronitrile or 2,3,3,3-tetrafluoro-2-(trifluoromethoxy) propanenitrile.

7 Claims, 1 Drawing Sheet

(56) References Cited

U.S. PATENT DOCUMENTS

| | | | | |
|---|---|---|---|---|
| 3,509,197 | A | 4/1970 | Mitsch | |
| 3,752,480 | A | 8/1973 | Mazuela | |
| 3,752,840 | A * | 8/1973 | Oxenrider | 558/336 |
| 4,547,316 | A | 10/1985 | Yamauchi | |
| 4,565,901 | A * | 1/1986 | Hirooka | H01B 3/16 174/17 GF |
| 4,899,249 | A * | 2/1990 | Reilly | H01B 3/24 174/17 LF |
| 7,807,074 | B2 | 10/2010 | Luly | |
| 8,080,185 | B2 | 12/2011 | Luly | |
| 2005/0119709 | A1* | 6/2005 | Gauglitz | A61N 1/375 607/36 |
| 2012/0289189 | A1 | 11/2012 | Kotalwar | |
| 2013/0292614 | A1* | 11/2013 | Tuma | H01B 3/24 252/571 |
| 2015/0083979 | A1* | 3/2015 | Costello | H01B 3/24 252/571 |
| 2015/0228375 | A1* | 8/2015 | Kieffel | H01B 3/56 361/604 |

FOREIGN PATENT DOCUMENTS

| | | | | |
|---|---|---|---|---|
| EP | 0131922 | | 1/1985 | |
| FR | 1265731 | | 6/1961 | |
| FR | 1265731 | A * | 6/1961 | H01B 3/16 |
| GB | 1242180 | | 8/1971 | |
| WO | WO 2011-090992 | | 7/2011 | |
| WO | WO 2012-102915 | | 8/2012 | |
| WO | WO 2015-177149 | | 11/2015 | |

OTHER PUBLICATIONS

Chemical Book, Perfluoroisobutyro nitrile. Aug. 2016.*

Syn Quest Heptafluoroisobutyronitrile Data (Year: 2015).*

Syn Quest Heptafluorobutyronitrile Data (Year: 2012).*

FR 1,265,731. Exact Translation. (May 1961). Provided by applicant for Application 14388301. (Year: 1961).*

Banks, "Preparation, Properties and Industrial Applications of Organofluorine Compounds", 1982, pp. 19-43.

Cameron, "Fluorierung von Chlorcyan and *N*-Chlordichlormethylenamin", Angewandte Chemie, 1975, vol. 87, No. 6, pp. 208-209.

MacDonald, "Interface effects in the electrical response of nonmetallic conducting solids and liquids", IEEE Transactions on Electrical Insulation, Apr. 1980, vol. EI-15, No. 2, pp. 66-82.

The National Institute of Standards and Technology (NIST) has published Technical Note 1425: "Gases for electrical Insulation and Arc Interruption: Possible Present and Future Alternatives to Pure $SF_6$", Nov. 1997. 56 pages.

Pinnock, "Radiative forcing of climate by hydrochlorofluorocarbons and hydrofluorocarbons", J. Geophys. Res., Nov. 1995, vol. 100, No. D11, pp. 23227-23238.

UNEP (United Nations Environment Programme), Kyoto Protocol to the United Nations Framework Convention on Climate Change, Nairobi, Kenya, 1997, pp. 1-34.

Wilson, "Insulating Liquids: their Uses, manufacture and properties", Peter Peregrinus Ltd., 1980, pp. 221.

International Search Report for PCT Application No. PCT/US2013/031854 dated Aug. 28, 2013, 3 pages.

* cited by examiner

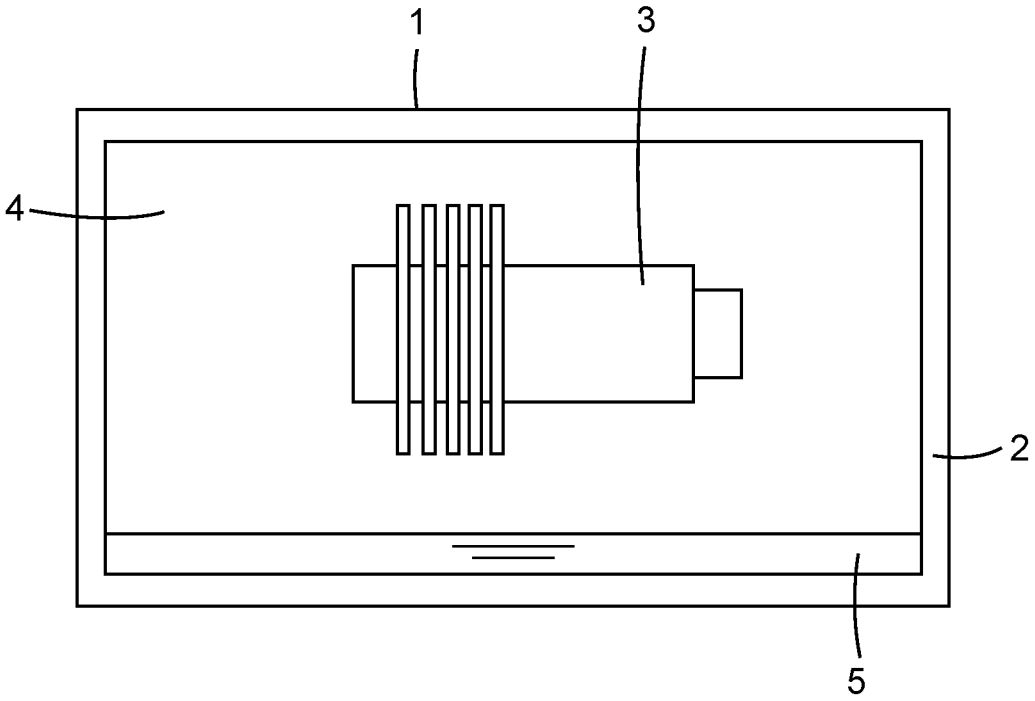
1
3
4
2
5

FLUORINATED NITRILES AS DIELECTRIC GASES

CROSS REFERENCE TO RELATED APPLICATIONS

This application is a continuation of U.S. Non-Provisional Application No. 14/388,301, filed Sep. 26, 2014, which is a national stage filing under 35 U.S.C. 371 of PCT/US2013/031854, filed Mar. 15, 2013, which claims priority to U.S. Provisional Application No. 61/620,192, filed Apr. 4, 2012, the disclosure of which is incorporated by reference in its entirety herein.

FIELD

The present disclosure relates generally to the use of dielectric fluids in electrical devices such as capacitors, switchgear, transformers and electric cables or buses. In particular, the present disclosure pertains to the use of heptafluoroisobutyronitrile or 2,3,3,3-tetrafluoro-2-(trifluoromethoxy) propanenitrile as dielectric fluids in electrical devices.

BACKGROUND

Dielectric gases are used in various electrical apparatuses such as, for example: transformers, electric cables or buses, and circuit breakers or switchgear. For example, see U.S. Pat. No. 7,807,074 (Luly et al.). In such electrical devices, dielectric gases are often used in place of air as an electrical insulator due to their higher dielectric strength (DS). Such dielectric gases allow higher power densities as compared to air-filled electrical devices.

Most significantly, sulfur hexafluoride ($SF_6$) has become the dominant captive dielectric gas in many electrical applications. $SF_6$ is advantageously nontoxic, non-flammable, easy to handle, has a useful operating temperature range, and excellent dielectric and arc-interrupting properties. Within transformers, it also acts as a coolant. Blowers within the transformer often circulate the gas aiding in heat transfer from the windings.

However, a concern with $SF_6$ is its 3200 year atmospheric lifetime and global warming potential (GWP) of about 22,200 times the global warming potential of carbon dioxide. At the December 1997 Kyoto Summit in Japan, representatives from 160 countries drafted an agreement containing limits for greenhouse gas emissions. The agreement covers six gases, including $SF_6$, and included a commitment to lower the total emissions of these gases by the year 2010 to levels 5.2% below their total emissions in 1990. See UNEP (United Nations Environment Programme), Kyoto Protocol to the United Nations Framework Convention on Climate Change, Nairobi, Kenya, 1997.

Certain perfluorinated nitriles $CF_3CN$, $C_2F_5CN$ and $CF_3CF_2CF_2CN$ have been disclosed for use as gaseous dielectric materials in U.S. Pat. No. 3,048,648 (the '648 patent). However, the toxicity of these nitriles is higher than would be considered acceptable for use as a gaseous dielectric material. In addition, the '648 patent describes the nitriles as "more particularly a member of the group of perfluoro-n-alkylnitriles". Efforts have been made to reduce the toxicity of $CF_3CF_2CF_2CN$ with the addition of nitrite esters (see U.S. Pat. No. 4,547,316).

The National Institute of Standards and Technology (NIST) has published Technical Note 1425: "Gases for electrical Insulation and Arc Interruption: Possible Present and Future Alternatives to Pure $SF_6$", which identifies, as possible replacements, mixtures of $SF_6$ with either nitrogen or helium, or high-pressure nitrogen. Some other replacement mixtures suffer from release of free carbon during arcing, increased toxicity during or after arcing, and increased difficulty in gas handling during storage, recovery and recycling. Also identified are perfluorocarbon (PFC) gases that might also be mixed with nitrogen or helium, like $SF_6$. However, PFCs also have high GWPs so the possible reduction in environmental impact of such strategies is limited.

SUMMARY

In one embodiment, provided is an electrical device that includes a dielectric fluid according to the formula: (i) $(CF_3)_2CFCN$; or (ii) $CF_3CF(OCF_3)CN$.

In one embodiment, provided is a dielectric composition. The dielectric composition includes a fluid according to the formula: (i) $(CF_3)_2CFCN$,or (ii) $CF_3CF(OCF_3)CN$, and a gaseous dielectric comprising an inert gas having a vapor pressure of at least about 70 kPa at 0° C.

In one embodiment, provided is a dielectric composition for use in an electrical device as an insulator. The dielectric composition includes a fluid according to the formula: (i) $(CF_3)_2CFCN$,or (ii) $CF_3CF(OCF_3)CN$.

BRIEF DESCRIPTION OF THE DRAWINGS

FIG. 1 is an illustration of electrical hardware that includes a fluorinated nitrile fluid in accordance with present disclosure.

DETAILED DESCRIPTION

As used herein, the singular forms "a", "an", and "the" include plural referents unless the content clearly dictates otherwise. As used in this specification and the appended embodiments, the term "or" is generally employed in its sense including "and/or" unless the content clearly dictates otherwise.

As used herein, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

As used herein, the term "dielectric fluid" is inclusive of both liquid dielectrics and gaseous dielectrics. The physical state of the fluid, gaseous or liquid, is determined at the operating conditions of temperature and pressure of the electrical device in which it is used.

As used herein, "perfluorinated" or the prefix "perfluoro" means an organic group wherein all or substantially all of the carbon bonded hydrogen atoms are replaced with fluorine atoms, e.g. perfluoroalkyl and the like.

In electrical devices such as capacitors, dielectric liquids are often used in place of air due to their low dielectric constant (K) and high dielectric strength (DS). Some capacitors of this type comprise alternate layers of metal foil conductors and solid dielectric sheets of paper or polymer film. Other capacitors are constructed by wrapping the metal foil conductor(s) and dielectric film(s) concentrically around a central core. This latter type of capacitor is referred to as a "film-wound" capacitor. Dielectric liquids are often used to impregnate dielectric films due to their low dielectric constant and high dielectric strength. Such dielectric liquids allow more energy to be stored within the capacitor (higher capacitance) as compared to air- or other gas-filled electrical devices.

The present disclosure, in illustrative embodiments, is directed to using heptafluoroisobutyronitrile, (CF3)2CFCN, or 2,3,3,3-tetrafluoro-2-(trifluoromethoxy) propanenitrile, CF3CF(OCF3)CN, as a dielectric fluid. In some embodiments, the heptafluoroisobutyronitrile or the 2,3,3,3-tetrafluoro-2-(trifluoromethoxy) propanenitrile are in the gas phase, liquid phase, or a combination thereof at the operating conditions of a device in which they are contained. The dielectric fluids of the present disclosure may be useful in a number of applications that use dielectric fluids. Examples of such other applications are described in the aforementioned NIST technical note 1425. The disclosure further provides an electrical device that includes the heptafluoroisobutyronitrile or the 2,3,3,3-tetrafluoro-2-(trifluoromethoxy) propanenitrile dielectric fluids of the present disclosure. In some embodiments, the present disclosure further provides a dielectric fluid comprising a mixture of a heptafluoroisobutyronitrile or 2,3,3,3-tetrafluoro-2-(trifluoromethoxy) propanenitrile and an inert gas, such as nitrogen, carbon dioxide, nitrous oxide ($N_2O$), helium, argon or air.

The heptafluoroisobutyronitrile and the 2,3,3,3-tetrafluoro-2-(trifluoromethoxy) propanenitrile dielectric fluids of the present disclosure advantageously have broad ranges of operating temperatures and pressures, are thermally and chemically stable, have higher dielectric strengths and heat transfer efficiencies than $SF_6$ at a given partial pressure, and have a lower global warming potentials (GWP) than $SF_6$. Additionally, the heptafluoroisobutyronitrile and the 2,3,3,3-tetrafluoro-2-(trifluoromethoxy) propanenitrile of the present disclosure have toxicities surprisingly lower than that found for other non-branched nitriles. The instant heptafluoroisobutyronitrile and the 2,3,3,3-tetrafluoro-2-(trifluoromethoxy) propanenitrile generally have dielectric strengths greater than about 5 kV at a pressure of 20 kPa at the operating temperature of an electrical device in which they are contained.

As used herein, global warming potential "GWP" is a relative measure of the warming potential of a compound based on the structure of the compound. The GWP of a compound, as defined by the Intergovernmental Panel on Climate Change (IPCC) in 1990 and updated in 2007, is calculated as the warming due to the release of 1 kilogram of a compound relative to the warming due to the release of 1 kilogram of $CO_2$ over a specified integration time horizon (ITH).

$$GWP_i(t') = \frac{\int_0^{ITH} a_i[C(t)]dt}{\int_0^{ITH} a_{CO_2}[C_{CO_2}(t)]dt} = \frac{\int_0^{ITH} a_i C_{oi} e^{-t/\tau_i} dt}{\int_0^{ITH} a_{CO_2}[C_{CO_2}(t)]dt}$$

In this equation $a_i$ is the radiative forcing per unit mass increase of a compound in the atmosphere (the change in the flux of radiation through the atmosphere due to the IR absorbance of that compound), C is the atmospheric concentration of a compound, □□ is the atmospheric lifetime of a compound, t is time, and i is the compound of interest.

The commonly accepted ITH is 100 years representing a compromise between short-term effects (20 years) and longer-term effects (500 years or longer). The concentration of an organic compound, i, in the atmosphere is assumed to follow pseudo first order kinetics (i.e., exponential decay). The concentration of $CO_2$ over that same time interval incorporates a more complex model for the exchange and removal of $CO_2$ from the atmosphere (the Bern carbon cycle model).

As a result of degradation in the lower atmosphere, heptafluoroisobutyronitrile and 2,3,3,3-tetrafluoro-2-(trifluoromethoxy) propanenitrile have shorter lifetimes and would contribute less to global warming, as compared to $SF_6$. The lower GWP of heptafluoroisobutyronitrile and 2,3,3,3-tetrafluoro-2-(trifluoromethoxy) propanenitrile in addition to the dielectric performance characteristics as well as their relatively low toxicity as compared to other perfluorinated nitriles, make them well suited for use as dielectric fluids.

Advantageously, the dielectric fluids of the present disclosure have a high electrical strength, also described as high breakdown voltage. Generally, "breakdown voltage," (at a specific frequency) refers to a voltage applied to a fluid that induces catastrophic failure of the fluid dielectric allowing electrical current to conduct through the gas. Thus, the fluid dielectrics of the present disclosure can function under high voltages. The fluid dielectrics can also exhibit a low loss factor, that is, the amount of electrical energy that is lost as heat from an electrical device such as a capacitor.

In addition to demonstrating dielectric gas performance, the heptafluoroisobutyronitrile and the 2,3,3,3-tetrafluoro-2-(trifluoromethoxy) propanenitrile provide additional benefits in safety of use and in environmental properties. For example, heptafluoroisobutyronitrile and 2,3,3,3-tetrafluoro-2-(trifluoromethoxy) propanenitrile have 4 hour inhalation lethal concentration at 50% ("LC-50", defined as the dose required to produce lethality in half the members of a tested population after a specified test duration) (in rats) values of about 15,000 ppm. This compares to a 4 hour inhalation LC50 of 2731 ppm for $CF_3CF_2CN$ and less than 6,000 ppm for $CF_3CF_2CF_2CN$. $CF_3CN$ has a 6 hour inhalation LC50 of 240 ppm. The nitriles of the present disclosure achieve these lower toxicities without the addition of additives such as nitrite esters as in U.S. Pat. No. 4,547,316.

The heptafluoroisobutyronitrile can be derived from the methyl ester $(CF_3)_2CFCO_2CH_3$ which can be prepared by electrochemical fluorination of, for example, isobutyric anhydride followed by distillation of the acid fluoride and reaction with methanol to give the ester. The methyl ester can be converted to the corresponding amide by reaction with anhydrous ammonia in an inert solvent such as diethyl ether. Conversion to the nitrile can be accomplished by dehydration of the amide with trifluoroacetic anhydride in the presence of pyridine. Other dehydrating agents such as phosphorous pentoxide or phosphorous oxytrichloride can also be employed. The resulting heptafluoroisobutyronitrile can then be purified by distillation.

In some embodiments, the heptafluoroisobutyronitrile has a gaseous phase range that encompasses the operating temperature range of an electrical device in which it is used as a dielectric component, and has a boiling point of approximately −4° C.

The 2,3,3,3-tetrafluoro-2-(trifluoromethoxy) propanenitrile can be derived from the methyl ester $CF_3CF(OCF_3)CO_2CH_3$ which can be prepared by electrochemical fluorination of, for example, CF3CF(OCH3)CO2CH3, which can be made by the addition of methanol to hexafluoropropylene oxide, followed by distillation of the acid fluoride and reaction with methanol to give the ester. The methyl ester can be converted to the corresponding amide by reaction with anhydrous ammonia in an inert solvent such as diethyl ether. Conversion to the nitrile can be accomplished by dehydration of the amide with trifluoroacetic anhydride in the presence of pyridine. Other dehydrating agents such as phosphorous pentoxide or phosphorous oxytrichloride can also be employed. The resulting 2,3,3,3-tetrafluoro-2-(trifluoromethoxy) propanenitrile can then be purified by distillation.

In various embodiments, the 2,3,3,3-tetrafluoro-2-(trifluoromethoxy) propanenitrile may have a gaseous phase range that encompasses the operating temperature range of an electrical device in which it is used as a dielectric component, and has a boiling point of approximately +5° C. to about 15° C.

The heptafluoroisobutyronitrile and the 2,3,3,3-tetrafluoro-2-(trifluoromethoxy) propanenitrile gaseous dielectrics have a vapor pressure of at least about 20 kPa at the operating temperature of an electrical device in which they are contained. Many electrical devices such as capacitors, transformers, circuit breakers, and gas insulated transmission lines may operate at temperatures of at least about 30° C. and above. The heptafluoroisobutyronitrile or the 2,3,3,3-tetrafluoro-2-(trifluoromethoxy) propanenitrile may have a vapor pressure of at least about 20 kPa at 25° C.

Further, the heptafluoroisobutyronitrile and the 2,3,3,3-tetrafluoro-2-(trifluoromethoxy) propanenitrile gaseous dielectric have a dielectric strength of at least about 5 kV at an operating pressure in the electric device, which is typically at least about 20 kPa. More particularly, the heptafluoroisobutyronitrile and the 2,3,3,3-tetrafluoro-2-(trifluoromethoxy) propanenitrile have a dielectric strength of at least about 10 kV at the operating temperature and pressure of the device.

In some embodiments, the heptafluoroisobutyronitrile or the 2,3,3,3-tetrafluoro-2-(trifluoromethoxy) propanenitrile dielectric fluids may be combined with a second dielectric gas with higher pressure. These dielectric gases have boiling points below about 0° C., have a zero ozone depletion potential, a global warming potential below that of $SF_6$ (about 22,200) and are chemically and thermally stable. The second dielectric gases include, for example, perfluoroalkanes with 1 to 4 carbon atoms. In some embodiments, the heptafluoroisobutyronitrile or the 2,3,3,3-tetrafluoro-2-(trifluoromethoxy) propanenitrile dielectrics may be combined with a hydrofluoroolefin such as $CF_3CF{=}CH_2$; $CF_3CH{=}CFH$; $CF_3CF{=}CFH$; $CF_3CH{=}CF_2$ or $HCF_2CF{=}CF_2$. In some embodiments, the heptafluoroisobutyronitrile or the 2,3,3,3-tetrafluoro-2-(trifluoromethoxy) propanenitrile dielectrics may be combined with a fluorinated ketone such as CF3C(O)CF(CF3)2, CF3CF2C(O)CF(CF3)2, CF3CF2CF2C(O)CF(CF3)2 or (CF3)2CFC(O)CF(CF3)2. In some embodiments, the heptafluoroisobutyronitrile or the 2,3,3,3-tetrafluoro-2-(trifluoromethoxy) propanenitrile dielectrics may be combined with a fluorinated oxirane as described in WO 2012102915 (Tuma). In some embodiments, the heptafluoroisobutyronitrile or the 2,3,3,3-tetrafluoro-2-(trifluoromethoxy) propanenitrile dielectrics may also be combined with a condensable or non-condensable gas. The gases include, but are not limited to: nitrogen, carbon dioxide, nitrous oxide ($N_2O$), helium, argon or air. Generally, the second gas or gaseous dielectric is used in amounts such that vapor pressure is at least about 70 kPa at 25° C., or at the operating temperature of the electrical device. In some embodiments, the ratio of the vapor pressure of the gas to the heptafluoroisobutyronitrile dielectric or the 2,3,3,3-tetrafluoro-2-(trifluoromethoxy) propanenitrile is at least about 2.5:1, particularly at least about 5:1, and more particularly at least about 10:1.

In some embodiments, the heptafluoroisobutyronitrile or the2,3,3,3-tetrafluoro-2-(trifluoromethoxy) propanenitrile may be combined with $SF_6$ such that the mixture has a global warming potential below that of $SF_6$ alone.

The heptafluoroisobutyronitrile and the 2,3,3,3-tetrafluoro-2-(trifluoromethoxy) propanenitrile may be useful in the gaseous phase for electrical insulation and for arc quenching and current interruption equipment used in the transmission and distribution of electrical energy. Generally, there are three major types of electrical devices in which the gases of the present disclosure can be used: (1) gas-insulated circuit breakers and current-interruption equipment including switchgear, (2) gas-insulated transmission lines, and (3) gas-insulated transformers. Such gas-insulated equipment is a major component of power transmission and distribution systems all over the world.

In some embodiments, the present disclosure provides electrical devices, such as capacitors, including metal electrodes spaced from each other such that the gaseous dielectric fills the space between the electrodes. The interior space of the electrical device may also include a reservoir of liquid heptafluoroisobutyronitrile or liquid 2,3,3,3-tetrafluoro-2-(trifluoromethoxy) propanenitrile which is in equilibrium with gaseous heptafluoroisobutyronitrile or gaseous 2,3,3,3-tetrafluoro-2-(trifluoromethoxy) propanenitrile. Thus, the reservoir may replenish any losses of the gaseous heptafluoroisobutyronitrile or the gaseous 2,3,3,3-tetrafluoro-2-(trifluoromethoxy) propanenitrile.

For circuit breakers, the thermal conductivity and dielectric strength of such gases, along with the thermal and dielectric recovery (short time constant for increase in resistivity), may provide for high interruption capability. These properties enable the gas to make a rapid transition between the conducting (arc plasma) and the dielectric state of the arc, and also enable it to withstand the rise of the recovery voltage.

For gas-insulated transformers, the heat transfer performance and compatibility with current devices, in addition to the dielectric characteristics, make the dielectric fluids of the present disclosure a desirable medium for use in this type of electrical equipment. The instant heptafluoroisobutyronitrile and the 2,3,3,3-tetrafluoro-2-(trifluoromethoxy) propanenitrile have distinct advantages over oil insulation, including having none of the fire safety problems or environmental compatibility issues, and having high reliability, little maintenance, long service life, low toxicity, ease of handling, and reduced equipment weight.

For gas-insulated transmission lines, the dielectric strength of the gaseous heptafluoroisobutyronitrile or the gaseous 2,3,3,3-tetrafluoro-2-(trifluoromethoxy) propanenitrile under industrial conditions may be significant, especially the behavior of the gaseous dielectric under metallic particle contamination, switching and lightning impulses, and fast transient electrical stresses. The gaseous heptafluoroisobutyronitrile or the gaseous 2,3,3,3-tetrafluoro-2-(trifluoromethoxy) propanenitrile may also have a high efficiency for transfer of heat from the conductor to the enclosure and may be stable for long periods (e.g., 40 years). These gas-insulated transmission lines may offer distinct advantages including, but not limited to: cost effectiveness, high-carrying capacity, low losses, availability at all voltage ratings, no fire risk, reliability, and a compact alternative to overhead high voltage transmission lines in congested areas that avoids public concerns with overhead transmission lines.

For gas-insulated substations, the entire substation (circuit breakers, disconnects, grounding switches, bus bar, transformers, etc., are interconnected) may be insulated with the dielectric fluids of the present disclosure, and thus, all of the above-mentioned properties of the dielectric gas are significant.

In some embodiments the gaseous dielectric may be present in an electric device as a gas per se, or as a gas in equilibrium with the liquid. In these embodiments, the liquid phase may serve as a reservoir for additional dielectric gases.

The use of the heptafluoroisobutyronitrile or the 2,3,3,3-tetrafluoro-2-(trifluoromethoxy) propanenitrile as a dielectric fluid is illustrated in the generic electrical device of FIG. 1. FIG. 1 illustrates a device including a tank or pressure vessel 2 containing electrical hardware 3, such as a switch, interrupter, or the windings of a transformer, and at least gaseous heptafluoroisobutyronitrile or gaseous 2,3,3,3-tetrafluoro-2-(trifluoromethoxy) propanenitrile 4. Optionally, the gaseous heptafluoroisobutyronitrile or the gaseous 2,3,3,3-tetrafluoro-2-(trifluoromethoxy) propanenitrile 4 is in equilibrium with a reservoir of a liquid heptafluoroisobutyronitrile or liquid 2,3,3,3-tetrafluoro-2-(trifluoromethoxy) propanenitrile 5.

In another aspect, an electrical device is provided including, as an insulating material, a dielectric liquid comprising heptafluoroisobutyronitrile or the 2,3,3,3-tetrafluoro-2-(trifluoromethoxy) propanenitrile. The dielectric fluids of the present disclosure may be useful in a number of other applications that use dielectric fluids. Examples of such other applications are described in U.S. Pat. Nos. 4,899,249 (Reilly et al.); 3,184,533 (Eiseman Jr.); UK Patent No. 1 242 180 (Siemens) and such descriptions are incorporated in their entirety herein by reference.

Conventional dielectric liquids such as petroleum mineral oils have found wide application due to their low cost and availability. However, their use has been limited in many electrical devices because of their relative low chemical stability and their flammability. Chlorinated aromatic hydrocarbons, for example, polychlorinated biphenyls (PCBs), were developed as fire-resistant insulating liquids, have excellent chemical stability, and have a much lower dielectric constant than the mineral oils. Unfortunately, certain PCB isomers have a high resistance to biological degradation and problems of toxicity are now being encountered due to PCB spillage and leakage. A. C. M. Wilson, *Insulating Liquids: Their Uses, Manufacture and Properties* 6 (Peter Peregrinus Ltd 1980), notes the use of PCBs are likely to be phased out as other more environmentally safe liquids become available.

Advantageously, the heptafluoroisobutyronitrile and the 2,3,3,3-tetrafluoro-2-(trifluoromethoxy) propanenitrile dielectric liquids have high dielectric strengths, also described as high breakdown voltage. A "breakdown voltage" as used in this specification means a voltage applied to a fluid that induces arcing. Thus, the dielectric fluids of the present disclosure can function under high voltages. The dielectric liquid of the present disclosure can also exhibit a low loss factor, that is, the amount of electrical energy that is lost as heat from an electrical device such as a capacitor.

In some embodiments, the heptafluoroisobutyronitrile dielectric fluid or the 2,3,3,3-tetrafluoro-2-(trifluoromethoxy) propanenitrile dielectric fluid, when used as liquid dielectrics, have liquid phase ranges that encompass the operating temperature range of an electrical device in which either or both are used as a component.

In various embodiments, minor amounts (<50 wt. %) of perfluorinated liquids may be blended with the heptafluoroisobutyronitrile or the 2,3,3,3-tetrafluoro-2-(trifluoromethoxy) propanenitrile The optional fluorinated, inert liquids can be one or a mixture of fluoroalkyl compounds having 5 to 18 carbon atoms or more, optionally, containing one or more catenary heteroatoms, such as divalent oxygen, hexavalent sulfur, or trivalent nitrogen and having a hydrogen content of less than 5% by weight or less than 1% by weight.

Suitable fluorinated, inert liquids useful of the present disclosure include, for example, perfluoroalkanes or perfluorocycloalkanes, such as, perfluoropentane, perfluorohexane, perfluoroheptane, perfluorooctane, perfluoro-1, 2-bis(trifluoromethyl)hexafluorocyclobutane, perfluorotetradecahydrophenanthrene, and perfluorodecalin; perfluoroamines, such as, perfluorotributyl amine, perfluorotriethyl amine, perfluorotriisopropyl amine, perfluorotriamyl amine, perfluoro-N-methyl morpholine, perfluoro-N-ethyl morpholine, and perfluoro-N-isopropyl morpholine; perfluoroethers, such as perfluorobutyl tetrahydrofuran, perfluorodibutyl ether, perfluorobutoxyethoxy formal, perfluorohexyl formal, and perfluorooctyl formal; perfluoropolyethers; hydrofluorocarbons, such as pentadecafluorohydroheptane, 1,1,2,2-tetrafluorocyclobutane, 1-trifluoromethyl-1,2,2-trifluorocyclobutane and 2-hydro-3-oxaheptadecafluorooctane.

In liquid-filled capacitors, it is advantageous to match the dielectric constant of the dielectric liquid with that of the dielectric film, that is, the dielectric constants of the two components should be approximately the same. In devices such as film-wound capacitors, the dielectric constant ($K_{total}$) of the device is a function of the following equation, wherein ($d_{total}$) represents the total thickness of the dielectric film(s) and of the dielectric liquid layer(s).

$$d_{total}/K_{total}=d_{film}/K_{film}+d_{fluid}/K_{fluid}$$

In view of the above equation, the dielectric constant of the device ($K_{total}$) is approximately that of the component having the lowest dielectric constant. For example, if the dielectric constant of the dielectric fluid is much lower than that of the dielectric film, the dielectric constant of the device is approximately that of the dielectric fluid. When the dielectric constant of the device is approximately that of the dielectric film, film breakdown and catastrophic failure of the capacitor can occur. Thus, it is desirable for the dielectric constant of the film and fluid to match, that is, be the same or substantially the same.

The dielectric liquid can be matched to a dielectric film, even if an appropriate dielectric liquid is not commercially available. Furthermore, such a dielectric liquid displays other desirable properties such as nonflammability, dielectric strength, chemical stability, or surface tension.

Objects and advantages of this disclosure are further illustrated by the following examples, but the particular materials and amounts thereof recited in these examples, as well as other conditions and details, should not be construed to unduly limit this disclosure.

EXAMPLES

The present disclosure is more particularly described in the following examples that are intended as illustrations only, since numerous modifications and variations within the scope of the present disclosure will be apparent to those skilled in the art. Unless otherwise noted, all parts, percentages, and ratios reported in the following example are on a weight basis.

Example 1

Preparation 1: Synthesis of Heptafluoroisobutyamide $(CF_3)_2CFCONH_2$.

100 grams (0.44 mol) of methyl heptafluoroisobutyrate (which was prepared by electrochemical fluorination of isobutyric anhydride in a Simons ECF cell of essentially the type described in U.S. Pat. No. 2,713,593 (Brice et al.) and in R. E. Banks, *Preparation, Properties and Industrial Applications of Organofluorine Compounds,* pages 19-43, Halsted Press, New York (1982) followed by distillation and treatment of the resulting acid fluoride with methanol) and 100 ml of methanol were added to a 250 ml round bottom flask with magnetic stirrer, thermocouple and dry ice condenser. 12.5 grams (0.74 mol) of ammonia was bubbled slowly into the liquid layer in the flask. The temperature was kept below 40° C. The reaction mixture was stirred for one hour after ammonia addition was complete. The methanol solvent was removed by rotary evaporation at 40° C./15 torr vacuum. The solids remaining in the flask were heated to 55° C. and the resulting liquid was poured into a bottle to yield 69.4 grams of $(CF_3)_2CFCONH_2$. The yield was 81.1%

Preparation 2: Synthesis Heptafluoroisobutyronitrile $(CF_3)_2CFCN$ 69.4 grams (0.326 mol) of $(CF_3)_2CFCONH_2$ were dissolved in 154 grams of dimethylformamide. The amide/solvent mixture was added to a 500 ml 3-neck round bottom flask equipped with overhead take-off with manual shut off valve, thermocouple, magnetic stirrer, dry ice condenser, dry ice cooled receiver and addition funnel. The flask contents were cooled to −10° C. and 51 grams (0.65 mol) pyridine was slowly added with addition funnel. 70 grams (0.33 mol) of trifluoroacetic anhydride were slowly added to the flask with the addition funnel. The temperature was kept at approximately 0° C. throughout the addition. The shut off valve was opened and material taken overhead while warming the pot to 15° C. 47.6 grams of $(CF_3)_2CFCN$ were recovered in a yield of 74.9%. The structure was confirmed by GC/MS, H-1 and F-19 NMR.

Example 2

Preparation of 2,3,3,3-tetrafluoro-2-(trifluoromethoxy)propanenitrile

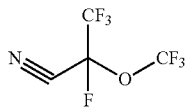

Methyl 2,3,3,3-tetrafluoro-2-methoxypropanoate can be purchased (Synquest Laboratories) or prepared by known methods of addition of hexafluoropropene oxide to methanol to produce the ester. The methyl 2,3,3,3-tetrafluoro-2-methoxypropanoate was converted to 2,3,3,3-tetrafluoro-2-(trifluoromethoxy)propanoyl fluoride by electrochemical fluorination using a Simons ECF cell of essentially the type described in U.S. Pat. No. 2,713,593 (Brice et al.) and in R. E. Banks, Preparation, Properties and Industrial Applications of Organofluorine Compounds, pages 19-43, Halsted Press, New York (1982).

2,3,3,3-tetrafluoro-2-(trifluoromethoxy)propanoyl fluoride (195 g) was charged to a 500 mL round bottom flask. The flask was kept cool using a dry ice/acetone bath. Methanol (80.7 g, 2.5 mol) was added to the acyl fluoride via an addition funnel while keeping the temperature below 10° C. Once the methanol addition was finished the mix was washed with water and then dried with anhydrous magnesium sulfate and filtered. Analysis by GC-FID showed 87.7% of the desired ester. Methyl 2,3,3,3-tetrafluoro-2-(trifluoromethoxy)propanoate (166 g) was charged to a 500 mL round bottom flask which was fitted with a gas addition line. About 200 mL of diethyl ether was added as a solvent. Ammonia (13.6 g, 0.8 mol, Matheson Tri-gas) was added to the ester to convert it to the amide. Once the addition of the ammonia was complete a sample was taken and analyzed by GC-FID. Analysis indicated the ester had been converted to amide. The solvent was removed via rotary evaporation. Approximately 150 g of amide was recovered at 99.5% purity.

Into a 1 L round bottom flask equipped with an addition funnel, thermocouple and dry-ice condenser distillation take-off, 2,3,3,3-tetrafluoro-2-(trifluoromethoxy)propanamide (150 g, 0.65 mol), dimethyl formamide (300 g, Sigma-Aldrich) and pyridine (103.6 g, 1.31 mol, Sigma-Aldrich) were charged. The mix was stirred and cooled to −20° C. Trifluoroacetic anhydride (137.5 g, 0.65 mol, Synquest Laboratories) was added via addition funnel slowly to the reaction mixture. The product, 2,3,3,3-tetrafluoro-2-(trifluoromethoxy)propanenitrile, was formed during the addition of the anhydride and was taken off into a flask cooled in dry ice. A total of 86 g of material was collected which was purified by fractional distillation. The structure of the material was confirmed by GC/MS and H-1 and F-19 NMR.

Dielectric Strength (DS) Measurement

The gaseous dielectric strength of comparative $SF_6$, heptafluoroisobutyronitrile and 2,3,3,3-tetrafluoro-2-(trifluoromethoxy) propanenitrile were measured experimentally using a Hipotronics OC90D dielectric strength tester (available from Hipotronics, Brewster, N.Y.) modified to allow low pressure gases. The electrode and test configuration comply with ASTM D877. The test chamber was first evacuated and the baseline dielectric strength was measured. Known quantities of $SF_6$, $(CF_3)_2CFCN$ or 2,3,3,3-tetrafluoro-2-(trifluoromethoxy) propanenitrile were then injected to achieve the measured pressure. The dielectric strength (DS) was recorded after each injection.

| SF6 | |
|---|---|
| Pressure (kPa) | DS (avg. KV) |
| 13.9 | 4.6 |
| 27.6 | 5.4 |
| 41.4 | 7.8 |
| 55.2 | 9.5 |

-continued

| SF6 | |
|---|---|
| Pressure (kPa) | DS (avg. KV) |
| 6 | 10.9 |
| 829.8 | 12.5 |
| 96.5 | 13.5 |
| 110.5 | 15.3 |
| 124.1 | 16.7 |
| 139.3 | 18 |
| 151.7 | 19.2 |

| heptafluoroisobutyronitile | |
|---|---|
| Pressure (kPa) | DS (avg. KV) |
| 0.0 | 4.1 |
| 13.8 | 6.3 |
| 27.6 | 10.1 |
| 41.4 | 14.2 |
| 55.3 | 17.9 |
| 69.2 | 20.9 |
| 82.8 | 24.3 |
| 96.7 | 26.6 |
| 110.5 | 30.1 |
| 124.1 | 31.9 |
| 137.8 | 34.4 |
| 151.8 | 37.5 |

| 2,3,3,3-tetrafluoro-2-(trifluoromethoxy) propanenitrile | |
|---|---|
| Pressure (kPa) | DS (avg. KV) |
| 7.0 | 4.6 |
| 13.9 | 6.3 |
| 27.8 | 10.3 |
| 41.4 | 14.0 |
| 55.2 | 17.5 |
| 68.9 | 20.4 |
| 82.7 | 23.5 |
| 97.1 | 26.6 |
| 110.3 | 29.3 |
| 124.1 | 31.7 |
| 137.9 | 34.7 |
| 151.7 | 35.9 |
| 165.5 | 40.0 |
| 179.6 | 40.8 |

Global Warming Potential (GWP)

A measured IR cross-section was used to calculate the radiative forcing value for $(CF_3)_2CFCN$ using the method of Pinnock, et al. (*J. Geophys. Res.,* 100, 23227, 1995). Using this radiative forcing value and the experimentally determined atmospheric lifetime, the GWP (100 year ITH) for $(CF_3)_2CFCN$ was found to be 2400. This is less than the GWP of 22,200 for $SF_6$. The shorter atmospheric lifetime of the $(CF_3)_2CFCN$ leads to a lower GWP than $SF_6$.

Quantitative Structure Activity Relationship data was used to calculate the radiative forcing value for 2,3,3,3-tetrafluoro-2-(trifluoromethoxy)propanenitrile and the atmospheric lifetime. The GWP (100 year ITH) for 2,3,3,3-tetrafluoro-2-(trifluoromethoxy)propanenitrile is estimated to be about 700. This is less than the GWP of 22,200 for $SF_6$. The shorter atmospheric lifetime of the $CF_3CF(OCF_3)CN$ leads to a lower GWP than $SF_6$.

The invention claimed is:

1. A device comprising a fluid mixture, the fluid mixture comprising a dielectric fluid according to the formula: (i) $(CF_3)_2CFCN$; or (ii) $CF_3CF(OCF_3)CN$; and a gas comprising carbon dioxide;

wherein the device comprises an electrical device;

wherein the electrical device is selected from the group consisting of: gas-insulated circuit breakers, current-interruption equipment, gas-insulated transmission lines, gas-insulated transformers, and gas-insulated substations; and wherein the dielectric fluid is present in the fluid mixture in at least an amount effective for electrical insulation of the electrical device and arc quenching when the electrical device is selected from the group consisting of: gas-insulated circuit breakers, current-interruption equipment, and gas-insulated substations.

2. The electrical device of claim 1, wherein the dielectric fluid is according to the formula: (i) $(CF_3)_2CFCN$.

3. A device comprising a dielectric fluid according to the formula: (i) $(CF_3)_2CFCN$; or (ii) $CF_3CF(OCF_3)CN$;

wherein the device comprises an electrical device;

wherein the electrical device is operated at a temperature and pressure;

wherein the dielectric fluid has a dielectric strength of at least 10 KV at the operating temperature and pressure of the electrical device;

wherein the electrical device is selected from the group consisting of: gas-insulated circuit breakers, current-interruption equipment, gas-insulated transmission lines, gas-insulated transformers, and gas-insulated substations; and wherein the dielectric fluid is present in the fluid mixture in at least an amount effective for electrical insulation of the electrical device and arc quenching when the electrical device is selected from the group consisting of: gas-insulated circuit breakers, current-interruption equipment, and gas-insulated substations.

4. The electrical device of claim 3, wherein the dielectric fluid is according to the formula: (i) $(CF_3)_2CFCN$.

5. A device comprising a fluid mixture comprising a dielectric fluid according to the formula: (i) $(CF_3)_2CFCN$; or (ii) $CF_3CF(OCF_3)CN$; and a gas comprising nitrogen, carbon dioxide, nitrous oxide (N2O), helium, air, or argon;

wherein the device comprises an electrical device;

wherein the ratio of the vapor pressure of the gas to the dielectric fluid is at least about 10:1;

wherein the electrical device is selected from the group consisting of: gas-insulated circuit breakers, current-interruption equipment, gas-insulated transmission lines, gas-insulated transformers, and gas-insulated substations; and wherein the dielectric fluid is present in the fluid mixture in at least an amount effective for electrical insulation of the electrical device and arc quenching when the electrical device is selected from the group consisting of: gas-insulated circuit breakers, current-interruption equipment, and gas-insulated substations.

6. The electrical device of claim 5, wherein the dielectric fluid is according to the formula: (i) $(CF_3)_2CFCN$.

7. The electrical device of claim 6, wherein the gas comprises carbon dioxide.

* * * * *